US006086287A

United States Patent [19]

Sharpe et al.

[11] Patent Number: 6,086,287

[45] Date of Patent: Jul. 11, 2000

[54] METHOD AND APPARATUS FOR LAYING ROADWAY MATERIALS

[76] Inventors: John Russell Sharpe, 72 Timbertop Drive, Umina NSW 2257; Alan Victor Sharpe, 119 Steyn Road, Saratoga NSW 2251; Ronald Douglas Sharpe, 42B Northburge Road, Woy Woy NSW 2256, all of Australia

[21] Appl. No.: 09/029,965

[22] PCT Filed: Sep. 20, 1996

[86] PCT No.: PCT/AU96/00598

§ 371 Date: Jul. 20, 1998

§ 102(e) Date: Jul. 20, 1998

[87] PCT Pub. No.: WO97/11229

PCT Pub. Date: Mar. 27, 1997

[30] Foreign Application Priority Data

Sep. 22, 1995 [AU] Australia ..... PN 5589

[51] Int. Cl.[7] ..... E01C 7/32; E01C 9/12; E01C 19/00; E01C 9/10

[52] U.S. Cl. ..... 404/75; 404/101; 404/104; 404/105; 404/110

[58] Field of Search ..... 404/72, 75, 101, 404/104, 105, 110

[56] References Cited

U.S. PATENT DOCUMENTS

| | | | |
|---|---|---|---|
| 3,130,654 | 4/1964 | Apel et al. | 404/105 |
| 3,541,934 | 11/1970 | Borgquist . | |
| 4,102,590 | 7/1978 | Zanzie . | |
| 4,496,265 | 1/1985 | Fragale . | |
| 4,749,304 | 6/1988 | Craig | 404/101 |
| 4,778,305 | 10/1988 | Ritchey et al. | 404/105 |
| 4,842,441 | 6/1989 | Watkins . | |
| 4,900,186 | 2/1990 | Swisher, Jr. et al. | 404/105 |
| 5,533,829 | 7/1996 | Campbell | 404/81 |

FOREIGN PATENT DOCUMENTS

| | | |
|---|---|---|
| 3427337 | 1/1986 | Germany . |
| 3916130 | 5/1990 | Germany . |
| 3842070 | 6/1990 | Germany . |
| 2043752 | 10/1980 | United Kingdom . |

*Primary Examiner*—Eileen Dunn Lillis
*Assistant Examiner*—Gary S. Hartmann
*Attorney, Agent, or Firm*—Marshall, O'Toole, Gerstein, Murray & Borun

[57] ABSTRACT

Method and apparatus for depositing roadway material on a road bed using a road paving machine having a spreader for laterally spreading the material and a screed for leveling the material. A guide underneath the spreader and the screed is used to control the height of the screed above the road bed. The guide also confines the width of the material deposited by the road paving machine to less than the width of the screed which is normally the standard width of material deposited by the road paving machine.

11 Claims, 8 Drawing Sheets

METHOD AND APPARATUS FOR LAYING ROADWAY MATERIALS

FIELD OF THE INVENTION

This invention relates to the laying of roadway materials, and in particular to the laying of relatively narrow sections of roadway materials using a road paving machine, including road base materials and road surface materials such as asphalt. The invention has particular application in the renewal of relatively narrow sections of damaged or deteriorated asphalt in an existing roadway.

BACKGROUND ART

Road paving machines are commonly employed when a new section of roadway is being laid. Commercially available road paving machines, such as those marketed by BLAW-KNOX™ and INGERSOL RAND™, are typically designed for laying sections of hot-mix asphalt in widths of 2400 mm and greater. Such machines require a full screed of asphalt material in order to ensure the correct functioning of the controls which determine the height of the new layer of asphalt. Whilst there are a number of specialised road paving machines designed to lay narrower sections of asphalt, even such specialised paving equipment cannot lay asphalt in widths of less than approximately 1200 mm.

However in some situations, such as a road repair operation, the width of the section of roadway to be laid is often less than 2400 mm, and frequently down to 1000 mm or less. Such a section is less than that which can be laid by a typical road paving machine, thereby preventing the use of the paving machine and necessitating that the section of asphalt be laid manually. Such situations can prove to be highly labour intensive, requiring labourers to manually deposit and spread the asphalt in the trench.

During a manual road repair operation spillage of asphalt material can occur whilst transferring the asphalt from a truck to the trench in the road. If a front-end loader vehicle, such as a BOBCAT™, is employed to transfer the asphalt from the truck to the repair site, the vehicle it can compress the spilled material into the road surface thereby making it difficult to remove after completion of the repair operation. It may then be necessary for labourers to scrape and rake the spilled material from the road surface and this clean up operation can be a time and labour intensive task.

Furthermore, the process of transferring the asphalt material from the truck to the repair site demands both time and labour. Typically, one person is required to operate a vehicle to transfer the replacement asphalt from the truck to the repair site, a further person is required to operate the truck, and an additional person may be required to ensure traffic control whilst the asphalt is transferred between the truck and the repair site. If the length of asphalt to be laid is extensive it may be necessary to move the location of the truck and result in further areas of spillage.

OBJECTS OF THE INVENTION

It is therefore an object of the present invention to provide an improved method for laying a relatively narrow section of roadway material, such as a road base material or asphalt, which reduces the time and labour requirements of the present methods.

It is a further object to provide a method of laying a relatively narrow section of roadway material, such as a road base material or asphalt, which enables a conventional road paving machine to be utilised.

DISCLOSURE OF THE INVENTION

To this end one aspect of the present invention provides a method of depositing a narrow section of roadway material, said method including using a road paving machine for depositing said material, wherein said method includes the use of a guide means to define a limit for the material deposited by the road paving machine and thereby confine the deposition of the material to said narrow section.

A further aspect of the present invention provides a method of depositing roadway material in a narrow section with a road paving machine, said method including the steps of locating guide means on opposing sides of said narrow section and depositing said roadway material with said road paving machine between said guide means, said guide means acting in association with said paving machine to limit the deposition of said material to within the confines of said narrow section.

The method of the present invention can be utilised in the deposition of a road surface material, such as a hot-mix asphalt. Alternatively the method can be utilised to deposit a road base material, such as a blue metal aggregate or the like.

Advantageously, in one form of the present invention it is possible for a conventional road paving machine to be utilised to deposit sections of road materials in widths which are less than the normal working width of the paving machine. Road paving machines are typically designed for laying sections of road materials in widths of 2400 mm and greater. However by using the method and apparatus of the present invention it is possible to use a conventional paving machine to deposit sections of road materials in widths down to approximately 600 mm.

By employing the present invention in the repair of relatively narrow sections of roadway the time and labour requirements to deposit new sections of asphalt are significantly reduced. Furthermore the incidence of spillage is reduced, which in turn reduces the time and labour requirements associated with post-repair clean up operations.

The method and apparatus of the present invention can be adapted to be used with any conventional road paver, such as those marketed by BLAW-KNOX™ and INGERSOL RAND™.

Preferably, the guide means is adapted to engage with the road paving machine and to move with the paving machine as the machine traverses and deposits road material on the roadway.

It is also preferable that the method includes the use of one or more spacer means to determine the height of deposition of the road material. The height of the spacer means should be such as to allow for compaction of the deposited material. Preferably the spacer means acts to determine the height of the screed surface above the road surface.

Preferably, the present method is employed in repairing an extended, relatively narrow, section of roadway. A trench is made in the roadway so as to remove the damaged or deteriorated section. Guides means are positioned on opposing sides of a trench so as to ensure the deposition of the road material is confined to the trench. A conventional roadway paver machine is then employed to fill the trench so as to provide a repaired section. In this way the time and labour requirements associated with filling the road section and performing subsequent clean up operations are significantly reduced.

This process is particularly suitable for repairing sections of road using hot mix asphalt.

BRIEF DESCRIPTION OF ACCOMPANYING DRAWINGS

The present invention will be better understood and appreciated from the following discussion of the features of preferred embodiments the invention may take. Reference is made to the accompanying drawings in which.

Figure 4A:
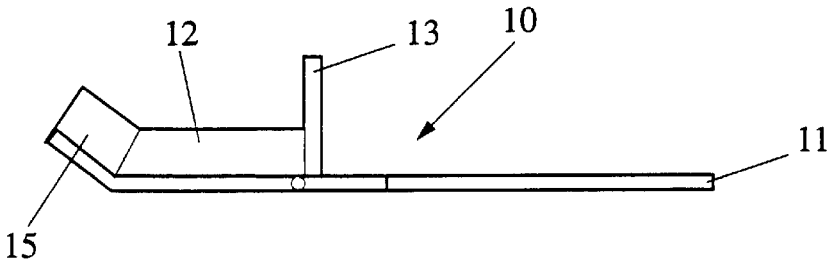
Figure 4B:
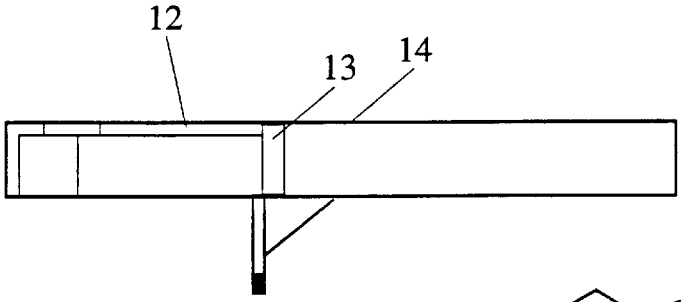
Figure 4C:
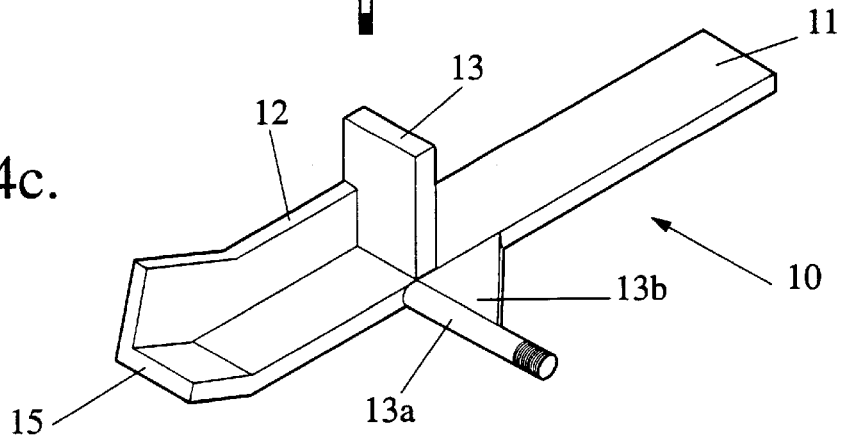

FIGS. 4*a*, 4*b* and 4*c* illustrate side, plan and perspective views respectively of one preferred embodiment of a paving guide utilised in the present invention.

Figure 5:
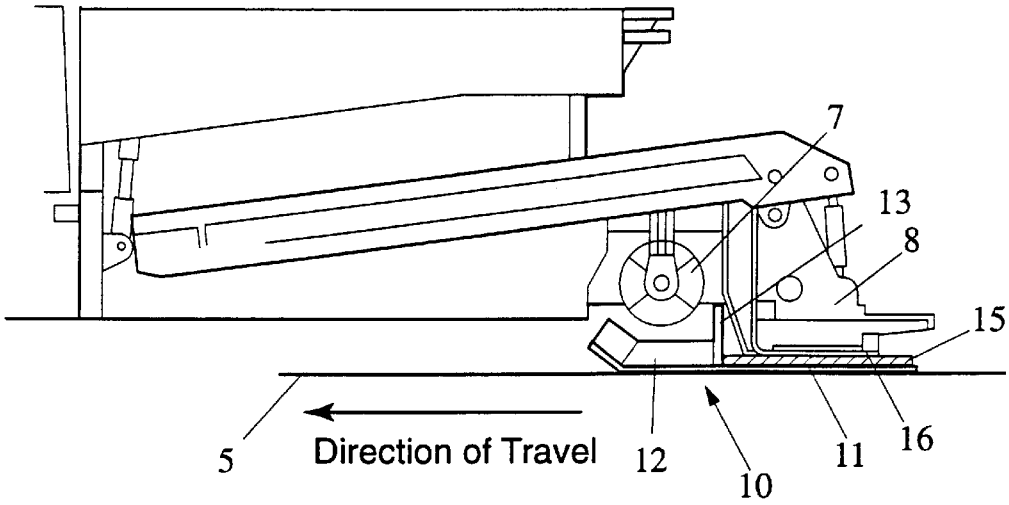

FIG. 5 illustrates the paving guide shown in FIGS. 4*a*, 4*b*, and 4*c* located in position with a road paving machine.

Figure 6:
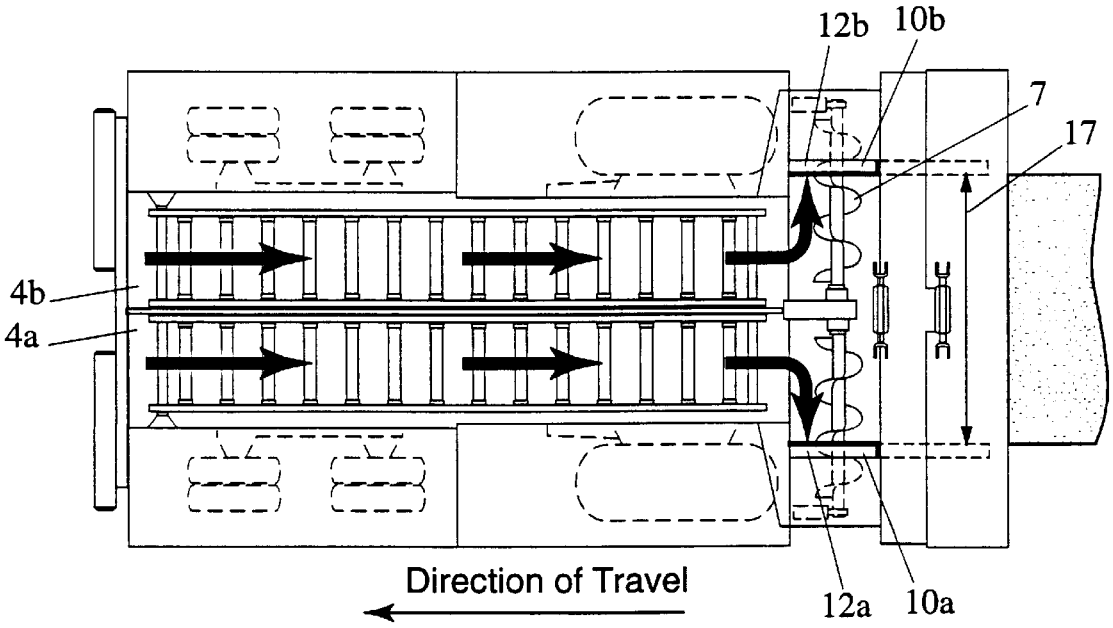

FIG. 6 is a simplified plan view of the road paving machine with one arrangement of paving guides for depositing a narrow section of road material.

Figure 7:
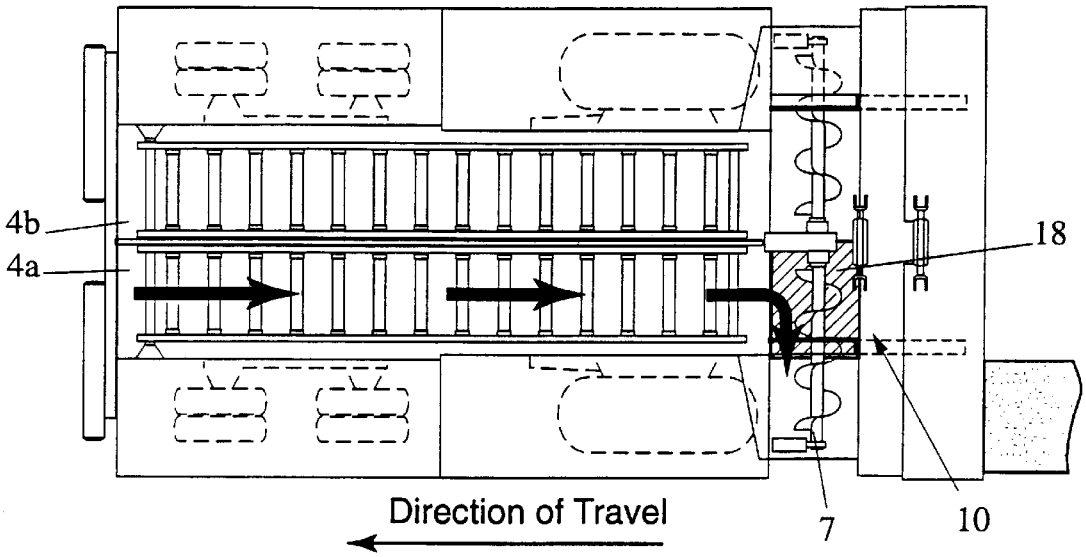

FIG. 7 is a simplified plan view of the road paving machine with an arrangement of paving guides for depositing a section of road material to one side of the paving machine.

Figure 8A:
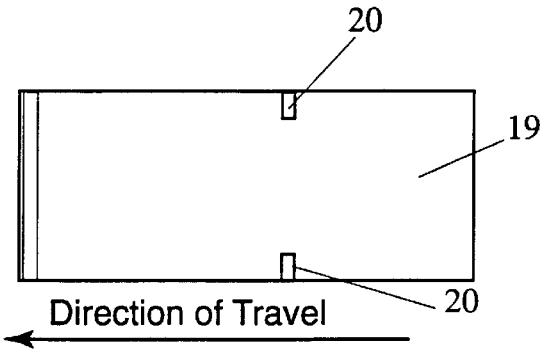
Figure 8B:
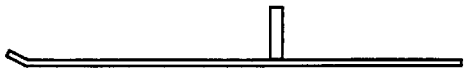
Figure 8C:
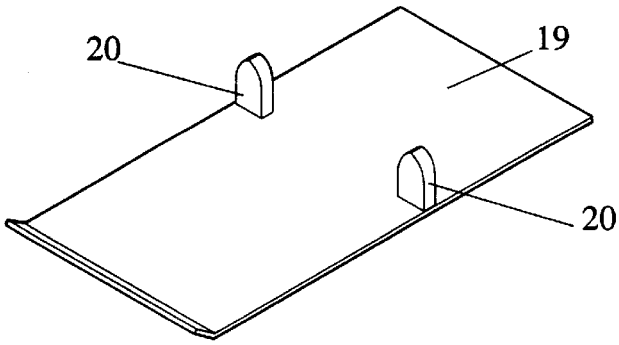

FIGS. 8*a*, 8*b* and 8*c* illustrate side, plan and perspective views respectively of a further preferred embodiment of a paving guide utilised in the present invention.

Figure 9:
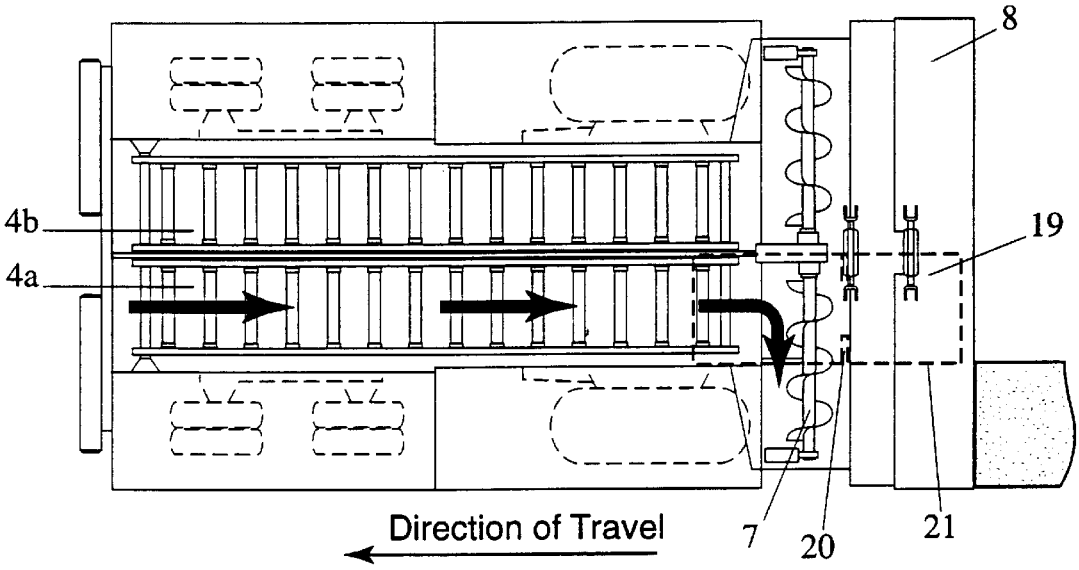

FIG. 9 is a simplified plan view of the road paving machine with a further arrangement of paving guides for depositing a section of road material to one side of the paving machine.

Figure 10A:
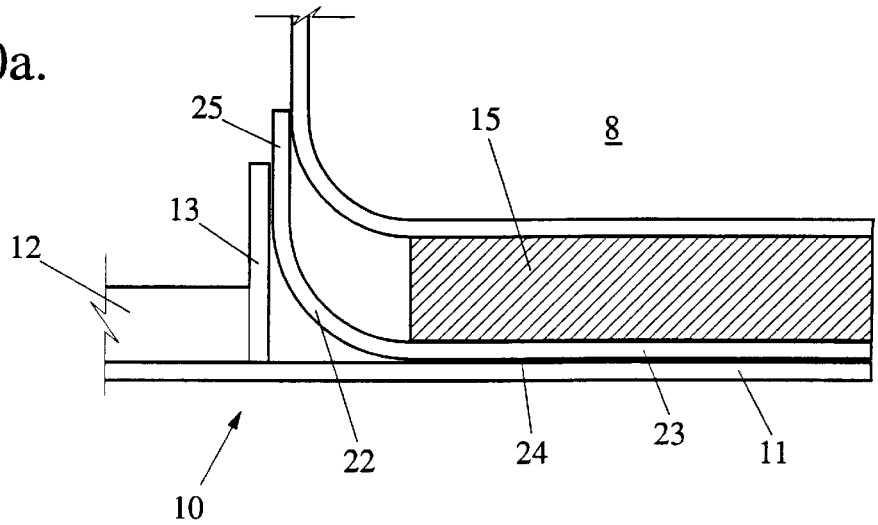

FIG. 10*a* is a simplified side view of a further preferred embodiment of a paving guide arrangement utilised in the present invention.

Figure 10B:
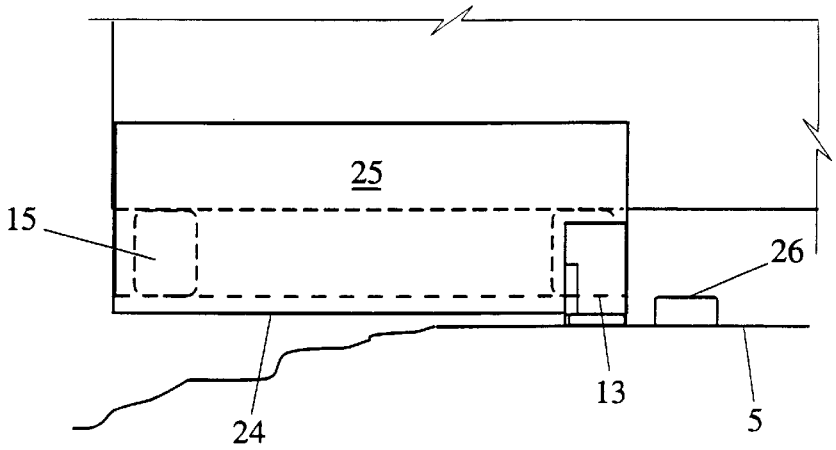

FIG. 10*b* is a simplified front view of the paving guide arrangement depicted in FIG. 10*a*.

Figure 10C:
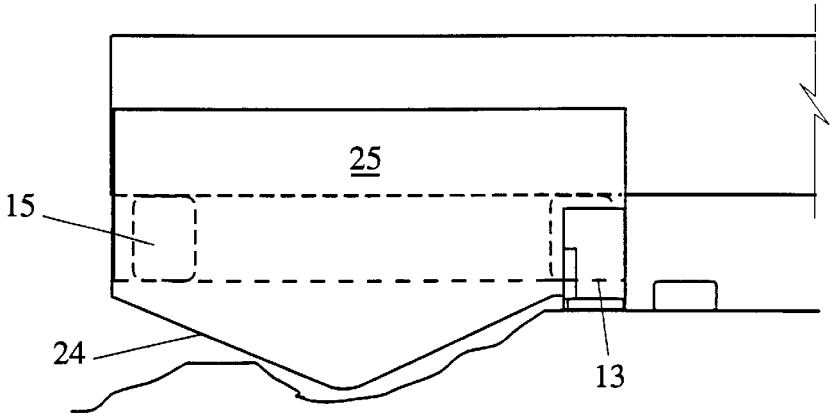

FIG. 10*c* is a simplified front view of an alternative paving guide arrangement to that depicted in FIGS. 10*a* and 10*b*.

Figure 11A:
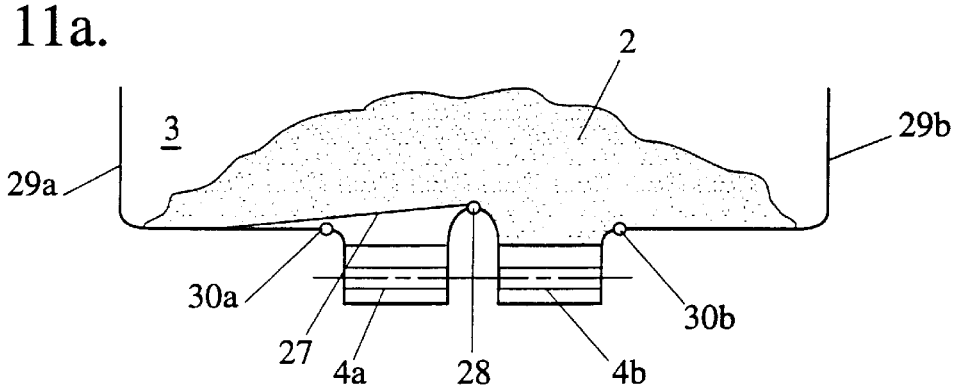
Figure 11B:
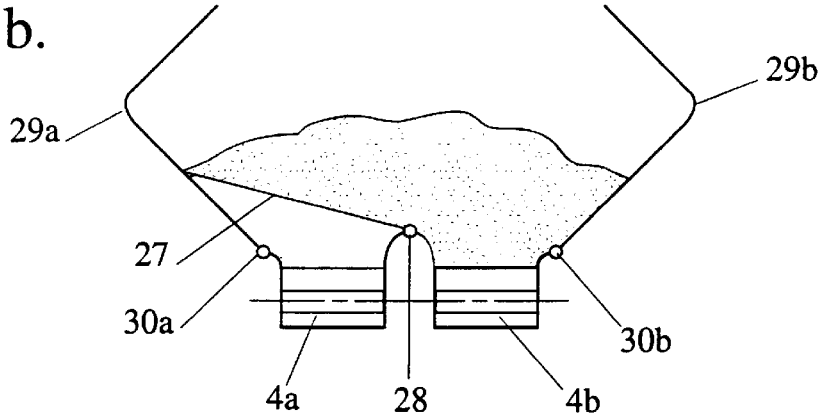

FIGS. 11*a* and 11*b* illustrate schematic end views of the hopper section of a typical paving machine incorporating a hinged floor member.

Figure 12:
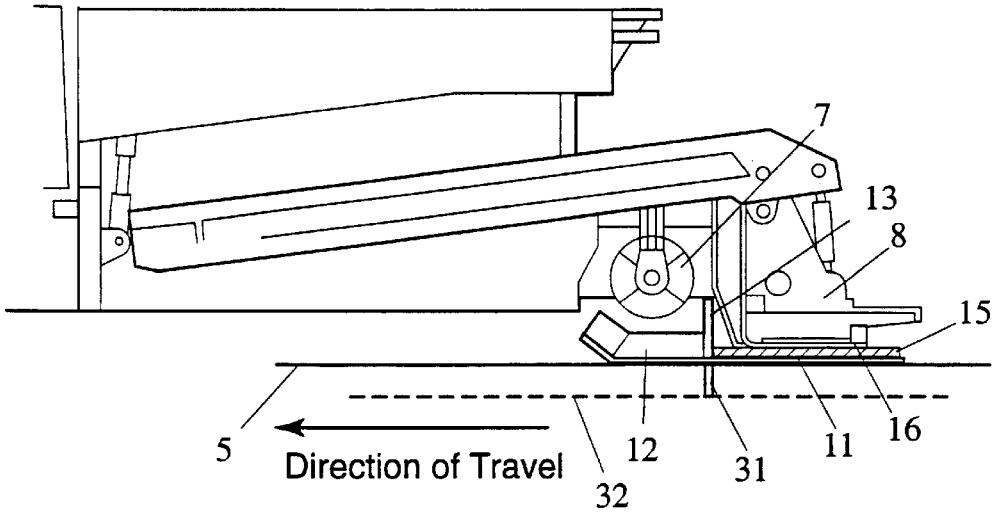

FIG. 12 illustrates a further preferred embodiment of a paving guide arrangement located in position with a road paving machine.

Figure 13:
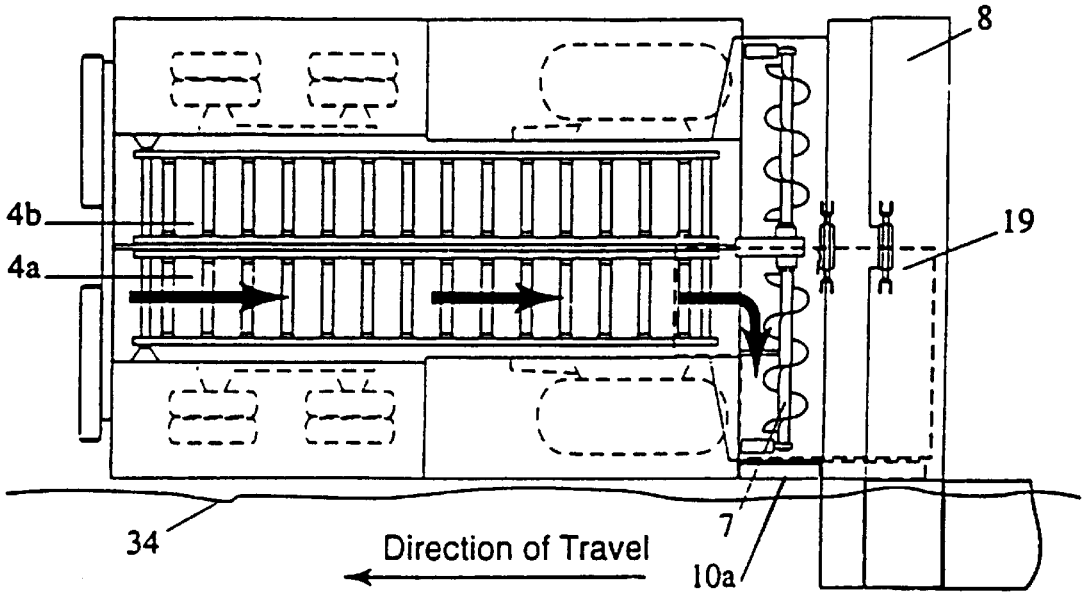

FIG. 13 illustrates a further preferred embodiment of a paving guide arrangement employed in conjunction with a road paving machine with an extendable screed.

Figure 14:
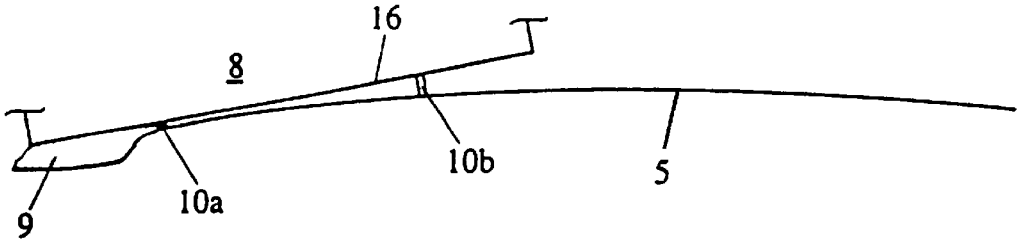

FIG. 14 schematically illustrates the use of paving guides of differing heights in order to adjust the angle of the screed of the paver as required by the camber of the road surface.

DESCRIPTION OF PREFERRED EMBODIMENTS

Figure 1:
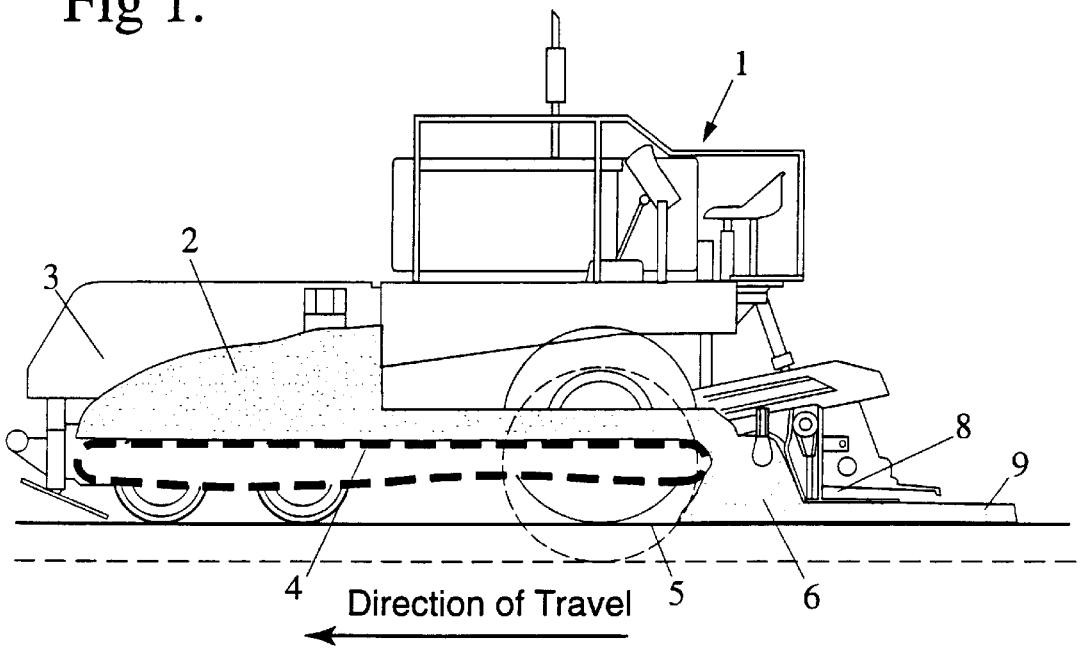
FIG. 1 is a side view of a typical road paving machine with which the present invention is utilised and illustrating the flow of road material through the machine.

Referring to FIG. 1, a typical commercially available road paving machine 1 is depicted. Hot mix asphalt 2 is held in a hopper section 3 of the machine and is fed via feed conveyors 4 towards the rear of the machine where it is deposited onto the roadway 5. The deposited material 6 is spread laterally by means of rotating augers 7 located forwardly of the screed section 8 of the paving machine. A layer of asphalt 9 of relatively uniform height is left on the roadway as the paving machine traverses from right to left as illustrated. In a preferred adaptation of the paving machine provided by the present invention the drive wheels of the machine may be mounted on hydraulic rams in order to vary the ground clearance of the machine. Preferably the wheels of the machine may be mounted on independent hydraulic rams so that the paving machine can be maintained at a horizontal level whilst negotiating trenches. Referring to FIG. 1, the extended position of the drive wheel of the machine when negotiating a trench is illustrated in broken line. The machine may also be provided with a ski plate at the lower front end of the machine which acts to guide the steering heels of the paving machine out of a trench.

Figure 2:
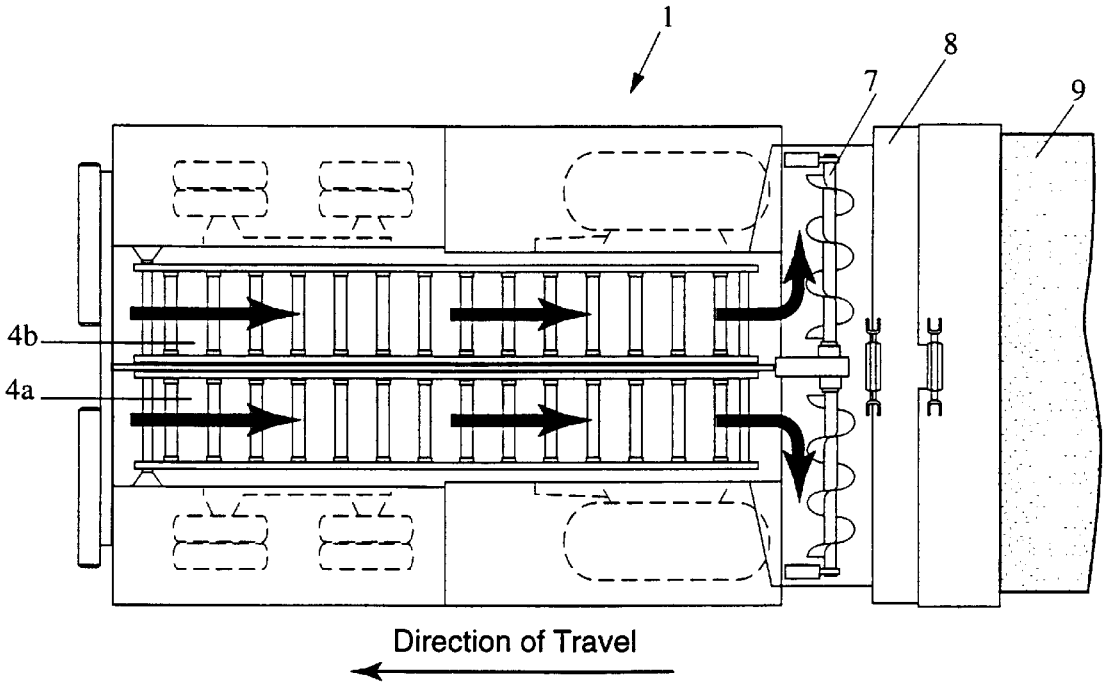
FIG. 2 is a simplified plan view of the road paving machine depicted in FIG. 1 illustrating the material flow path through the machine.

FIG. 2 illustrates the flow of the asphalt material through the paving machine. In the machine depicted there are left and right feed conveyors 4*a*, 4*b* which feed the asphalt from the hopper section 3.

Figure 3:
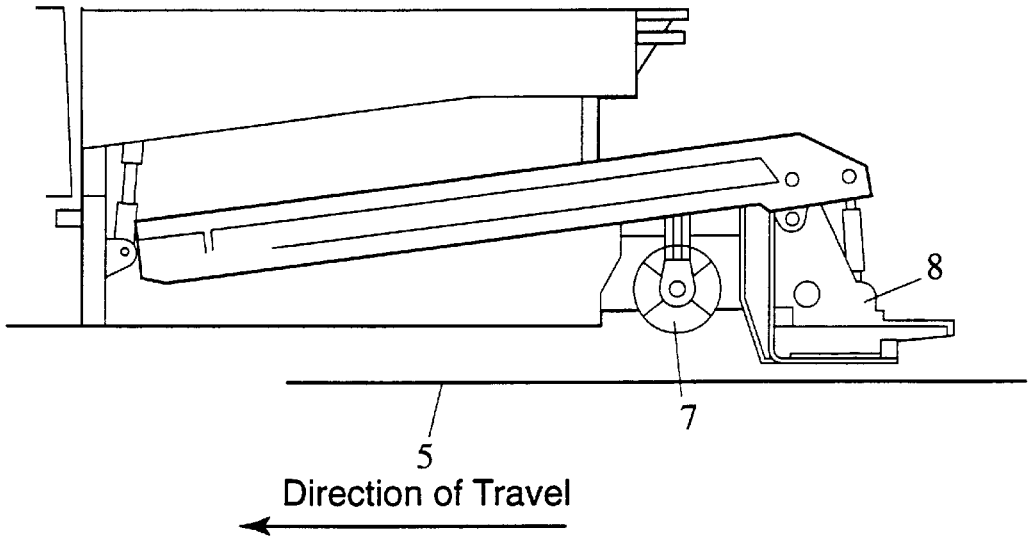
FIG. 3 is a simplified side view of the paving mechanism of a typical road paving machine illustrating the relationship between the augers and the screed of the paving mechanism.

FIG. 3 illustrates the location of the spreading augers 7 in relation to the screed 8 on a typical commercially available road paving machine.

FIGS. 4*a*, 4*b*, and 4*c* depict one embodiment of a paving guide arrangement utilised in the present invention. The paving guide 10 includes a sole plate 11 which rests upon and moves along the road surface 5. An upwardly extending wall member 12 is provided at a front portion of the paving guide to restrict the deposition of road material to an area lying to one side of the guide. It is preferred that the wall member 12 extends approximately 50 mm above the road surface so as to provide adequate cut off of the deposited material whilst also avoiding fouling of the auger mechanism of the paving machine. The paving guide 10 also includes an upwardly projecting member or lug 13 which is adapted to contact or engage with the paving mechanism of the paving machine so that the paving guide 10 is pushed along the roadway as the machine traverses the section of road to be repaired. The wall member 12 is located adjacent a longitudinal outer edge 14 of the sole plate and extends forwardly of the lug 13. The forward end 15 of the paving guide is turned upwardly so as to assist the guide in riding over any irregularities that may be encountered in the road surface. The paving guide may further include an adjustable connection means 13*a* for connecting the guide to the paving mechanism. The connection means preferably comprises a threaded rod member 13*a* to connect the paving guide to the screed of the paving machine. The rod member 13*a* is supported by a gusset plate 13*b*.

FIG. 5 illustrates a paving guide 10 located in position with the paving machine. The lug member 13 of the paving guide contacts a forward surface of the screed 8 of the paving mechanism. In this way the paving guide 10 is pushed along the roadway 5 as the paving machine traverses the section of road to be repaired. A spacer means 15 is employed between the sole plate 11 of the paving guide and the screed plate 16 of the screed 8. The spacer means 15 is used to control the height of the deposition of uncompacted asphalt in relation to the level of the existing roadway and also protects the screed plate from being damaged. The spacer 15 can be made from suitable material, with timber being preferred. A range of spacers of varying heights can be used so as to accommodate for filling trenches of different depths and to allow for the compaction of the asphalt material after it has been deposited. It is also possible for the spacer means to take the form of an adjustable means so as to enable the height of the deposited material to be controlled between a range of heights. In one application of the present invention replacement asphalt is deposited in a trench to a height above that of the level of the existing roadway in order to accommodate for compaction of the material. Hot mix asphalt material can typically experience a compaction ratio of approximately 20% to 25%. Therefore, for a trench depth of 25 mm the allowance for compaction is typically an additional 5 mm, whilst for a 150 mm depth of trench the additional allowance for compaction is a further 30 mm. By changing the height of the spacers employed different depths of trench can be accommodated.

Referring to FIG. 6 in conjunction with FIG. 5, one embodiment of an arrangement according to the present invention is illustrated. The arrangement depicted can be used when depositing a narrow section of replacement asphalt in a repair trench of a roadway. In this application paving guides 10*a*, 10*b* are located beneath the paving mechanism of the machine on opposing sides of the repair trench. The walls 12*a*, 12*b* of the respective guides are located beneath the augers and act to restrict the deposition of the road material to the area 17 lying between the walls of the guides. The guides 10*a*, 10*b* are pushed along the roadway by the screed 8 as the paving machine traverses the repair trench.

Referring to FIG. 7 a further embodiment of the present invention is depicted. In this arrangement a cowl or diverter 18 is used in conjunction with a paving guide for depositing material to one side of the paving machine as illustrated. This arrangement is particularly suitable for repairing edges of roadways. The diverter 18 takes the form of a plate which is located at the end of the feed conveyor 4 and beneath the auger 7. The diverter 18 acts to prevent material from falling directly from the feed conveyor 4 onto the road surface. The auger 7 in conjunction with diverter 18 acts to deposit material to the outer side of the paving guide 10. In the application depicted feed conveyor 4*a* is active, whilst feed conveyor 4*b* is shut off. In this way asphalt can be deposited to one side of the paving machine as is desirable when repairing an edge or shoulder of a roadway.

FIGS. 8*a*, 8*b*, and 8*c* depict an alternative embodiment of a paving guide which may be utilised with the present invention. In this embodiment the guide takes the form of a plate 19 which includes upwardly projecting lugs 20 adapted to contact with the paving machine so that the plate is moved along the roadway with the machine.

FIG. 9 illustrates a plan view with the paving plate 19 in use. The lugs 20 contact the forward surface of the screed 8 of the paving machine. In this application feed conveyor 4*b* is either inoperative or blanked off. The road material is deposited via feed conveyor 4*a* onto the paving plate. The auger 7 then acts to spread the material laterally out to the side of the machine and beyond the outer edge 21 of the paving plate 19. In this way road material is prevented from being deposited in the area covered by the paving plate.

FIGS. 10*a*, 10*b* and 10*c* illustrate further alternative embodiments of paving guide arrangements in accordance with the present invention. FIG. 10*a* depicts a schematic side view of an arrangement in which an additional member 22 is utilised to act as a screed plate. The screeding member 22 includes a lower portion 23 with a flat surface 24 and an upwardly projecting forward portion 25. The lower portion 23 of the screeding member 22 is located between the sole plate 11 of the paving guide and a spacer 15. The forward wall 24 of the screeding member 22 is positioned between the lug 13 of the paving guide 10 and the front surface of the paver screed 8 so that the screeding member 22 moves with the guide 10 as the paving machine traverses the roadway. This arrangement is particularly useful when repairing sections of roadway which include obstacles such as road reflectors 26. The screed plate 22 provides a screeding surface 24 whilst the spacers 15 lift the screed 8 of the paver above the level of the roadway 5 and clear of obstacles.

In FIG. 10*c* the lower portion 23 of the screeding member 22 is shaped in the form of a vee. This arrangement provides a screeding surface 24 which is particularly useful when repairing or forming vee shaped drains on the side of a roadway.

FIGS. 11*a* and 11*b* illustrate schematic end views of the hopper section 3 of a typical paving machine. In a further feature of the present invention the hopper section 3 includes a hinged floor member 27 which acts to block material from one of the feed conveyors 4*a*. The floor member 27 extends along the length of the feed conveyor and is pivotable about end hinge point 28. The side walls 29*a*, 29*b* of the hopper section are hinged at points 30*a*, 30*b* respectively. As illustrated in FIG. 11*b*, as the side wall 29*a* of the hopper section pivots upwardly the floor member 27 is lifted upwardly about its end pivot point 28. This upward movement of the floor member 27 acts to assist in transferring road material in the hopper to the operative feed conveyor 4*b*. In an alternative arrangement the floor member 27 can be pivoted about its hinge point 28 so as to cover feed conveyor 4*b*.

In the arrangement depicted in FIG. 12 the paving apparatus further incorporates a vertically adjustable blade 31 which extends between the guides 10 located on opposing sides of the trench. The width of the blade is adjustable so as to accommodate for varying trench widths. The blade 31 is adapted to be capable of extending below the level of the existing roadway surface. This arrangement can be utilised where it is desired to lay a section of road material, such as blue-metal road base or asphalt, in a trench which is to lie below the level of the surrounding asphalt. The blade 31 acts a screed to define the level 32 of the material deposited in the trench.

Referring to FIG. 13, it is possible to utilise the paving guide arrangements described in conjunction with a road paving machine with an extendable screed. This arrangement is particularly applicable when repairing the edge or shoulder of a roadway where it is desired to keep the wheels of the paving machine on the existing road surface. As illustrated, road material is diverted to the outer side of the paving guide whilst the wheels of the machine remain on the existing road surface.

Referring to FIG. 14 the screed angle can be adjusted in accordance with the camber of the road surface by utilising paving guides of varying heights. Again, this arrangement is particularly applicable when repairing the edge or shoulder of a roadway. By utilising spacers of differing heights on each side of the screed, the screen can be angled as required.

Advantageously with the present invention any spillage or excess of road material associated with repairing a relatively narrow section of roadway is contained to the immediate proximity of the trench area, and more importantly is not compressed into the surrounding road surface. After the paver has traversed and filled the trench it is simply a matter of trimming the edges of the trench. This represents a significant saving in terms of labour and time.

Employing a paving machine to repair narrow sections of road has the further advantage of ensuring consistent compaction in the repaired section. Manually filling a section of road can result in uneven compaction. However using the paver machine in conjunction with the paving guides, consistent degree compaction can occur over the full extent of the repaired section.

Furthermore, using a conventional paving machine in conjunction with various arrangements of paving guides as have been exemplified makes for a significantly more flexible paving machine capable of depositing road material in widths from 4000 mm with a fully extended screed, down to approximately 600 mm, as well as enabling the paving machine to be used for the restoration of road edges and shoulders.

Thus, it can be appreciated that the present invention provides a method of depositing a relatively narrow section of roadway material, such as a road base material or asphalt, which enables the use of a conventional road paving machine and which in turn affords a significant reduction in time and labour requirements in depositing the roadway material.

What is claimed is:

1. A method of depositing roadway material on a road bed using a road paving machine, said road paving machine including spreading means for laterally spreading said material on said road bed and a screed located rearwardly of said spreading means for leveling said roadway material, wherein said method includes a step of locating a guide means underneath said spreading means and said screed so as to control the height of the screed above the road bed and confine the deposition of the material to a section of the road bed of a width which is less than that of the screed.

2. The method of depositing roadway material using a road paving machine as claimed in claim 1 wherein said spreading means comprises one or more augers.

3. The method of depositing roadway material using a road paving machine as claimed in claim 1 wherein said guide means is adapted to engage with the road paving machine and to move with the paving machine.

4. The method of depositing roadway material using a road paving machine as claimed in claim 3 wherein said guide means includes a sole plate which rests upon and moves along a road surface as the paving machine progresses.

5. The method of depositing section of roadway material using a road paving machine as claimed in claim 3 wherein said guide means includes a member adapted to contact the screed of the paving machine such that said guide means is forced to move with the road paving machine as the paving machine progresses.

6. The method of depositing roadway material using a road paving machine as claimed in claim 1 wherein a spacer means is used to control the height of the screed above the road bed.

7. The method of depositing roadway material using a road paving machine as claimed in claim 6 wherein said spacer means is of a height which allows for compaction of the deposited material.

8. The method of depositing roadway material using a road paving machine as claimed in claim 1 wherein said guide means includes an upwardly extending wall member to restrict the deposition of road material to an area lying to one side of the guide means.

9. The method of depositing roadway material using a road paving machine as claimed in claim 8 wherein said wall member of said guide means is located beneath said spreading means of the paving machine and acts to confine the deposition of the road material to an area lying to one side of the guide.

10. The method of depositing roadway material using a road paving machine as claimed in claim 1 wherein a diverter means is used in conjunction with said guide means to deposit the material to one side of the paving machine.

11. The method of depositing roadway material using a road paving machine as claimed in claim 10, said road paving machine including a feed conveyor, wherein said diverter means is located at one end of the feed conveyor of the paving machine and acts to prevent material from falling directly from said feed conveyor onto the road bed, said diverter acting in conjunction with said spreading means of the paving machine to deposit the material to an outer side of the guide means.

* * * * *